United States Patent [19]

Rutchik

[11] 4,175,345

[45] Nov. 27, 1979

[54] DISPLAY DEVICE

[75] Inventor: Robert K. Rutchik, Vernon Hills, Ill.

[73] Assignee: Rapid Mounting & Finishing Company, Chicago, Ill.

[21] Appl. No.: 896,493

[22] Filed: Apr. 14, 1978

[51] Int. Cl.[2] ..... G09F 11/02

[52] U.S. Cl. ..... 40/473; 40/476; 40/503

[58] Field of Search ..... 40/473, 476, 482, 486, 40/487, 488; 74/49, 50

[56] References Cited

U.S. PATENT DOCUMENTS

| | | | |
|---|---|---|---|
| 1,711,790 | 5/1929 | Johnson | 40/473 |
| 3,305,958 | 2/1967 | Price | 40/503 |
| 3,594,934 | 7/1971 | Burnbaum | 40/473 |

FOREIGN PATENT DOCUMENTS

| | | | |
|---|---|---|---|
| 2755810 | 6/1978 | Fed. Rep. of Germany | 40/503 |

*Primary Examiner*—John F. Pitrelli

*Attorney, Agent, or Firm*—Wegner, Stellman, McCord, Wiles & Wood

[57] ABSTRACT

A display device having a base, a first display, and a rotary drive for rotating the first display about a preselected rotation axis. Second and third displays are connected to the drive through a suitable connecting structure so as to be moved reciprocably relative to each other while being rotated about the preselected axis concurrently with the first display. The connecting structure may include a control lever which is pivotally mounted with portions at opposite sides of the pivot connected to the second and third displays, respectively, for effecting reciprocal movement thereof toward and from each other. The connecting structure may include a motion translating structure effecting operation of the reciprocating structure as the result of the rotation of the first display about the preselected rotation axis.

14 Claims, 7 Drawing Figures

7.
43
14
15
41
42
52
29
54
30
51
49
31
12
33
37
28
27
48
46
53
55
34
16
36
23
35
26
44
25
24
5.
22
21
20
47
18
19
17
11

43
15
37
14
38
42
29
40
39
31
32
30
49
12
33
50
28
48
46
34
15
26
45
44
47
22
18
11

DISPLAY DEVICE

BACKGROUND OF THE INVENTION

1. Field of the Invention

This invention relates to display devices and in particular to display devices which are rotatable on a base and which include means for effecting additional movement of different displays for forming a portion of the device.

2. Description of the Prior Art

In one conventional form of display device, a display is rotatably rotated about a vertical axis by means of a suitable drive carried by a base portion of the device. Thus, the display may comprise a three-dimensional display which exhibits different presentations to the viewer as the display is rotated before his eyes.

SUMMARY OF THE INVENTION

The present invention comprehends the provision of such a display device wherein additional displays are associated with the rotating display and which are connected suitably to be moved relative to each other as well as concurrently with the first display as it is rotated about the vertical axis.

In the illustrated embodiment, the first display defines a parallelepiped display with the second and third displays effectively defining sleeve-type displays which are movable toward and from each other while being rotated concurrently with the first display about the vertical axis by the drive means which may be mounted in a subjacent base.

The reciprocation of the second and third displays may be effected by means of a bull ring carried on the base and a gear carried by the first display so as to mesh with the bull ring and cause suitable driving of a reciprocating means forming another portion of the connecting means between the bull gear and the second and third displays.

In the illustrated embodiment, the connecting means may include a control lever having a midportion pivotally mounted to the first display for pivoting about a horizontal axis. The level is pivoted by means responsive to rotation of the first display. The connecting means further includes links connecting the second and third displays to opposite portions of the level so as to effect movement of the second and third displays toward and from each other in the operation of the display device.

The display device of the present invention is extremely simple and economical of construction while yet providing a highly improved multimovement display.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 6:
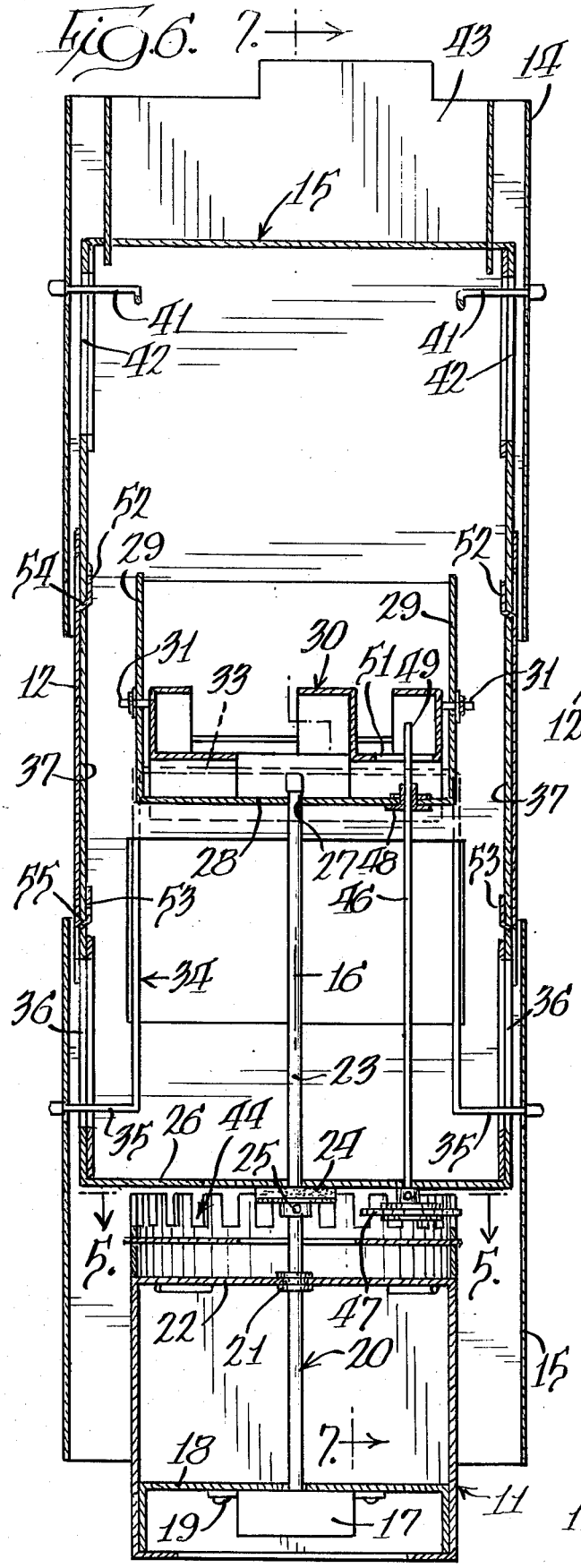
FIG. 6 is a vertical section taken substantially along the line 6—6 of FIG. 4.
Figure 7:
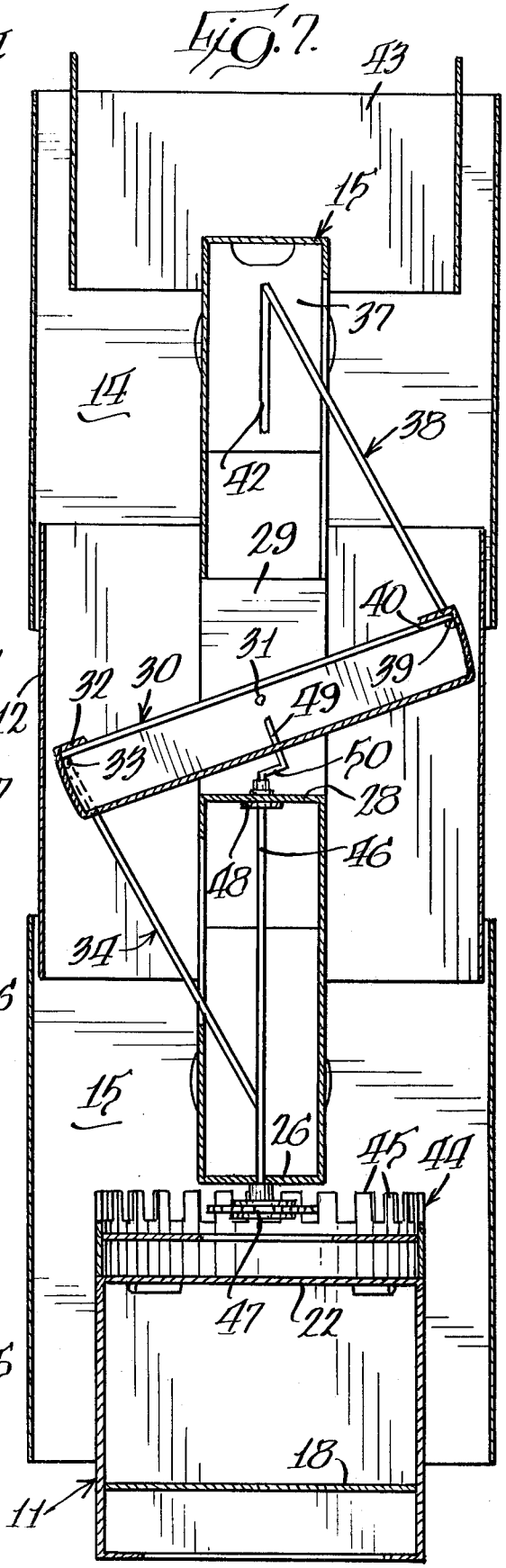
FIG. 7 is a vertical section taken substantially along the line 7—7 of FIG. 6.

In the exemplary embodiment of the invention as disclosed in the drawing, a display device generally designated 10 includes a base 11, a first display 12, a second display 13, and a third display 14. The displays are mounted to a carrier 15 which is rotated about a vertical axis 16 by a drive motor 17 carried by the base 11. Motor 17 may be secured to a horizontal divider wall 18 of the base 11 by suitable means, such as screws 19 and drives a vertically upstanding shaft 20 which is journaled by suitable bearings 21 in an upper horizontal divider wall 22. Upper end 23 of the shaft 20 is provided with a support collar 24 secured to the shaft by a suitable set screw 25 for supporting the bottom wall 26 of carrier 15. The distal end 27 of the shaft extends through an upper transverse wall 28 of the carrier for stabilizing the carrier on the shaft. As shown in FIGS. 6 and 7, the carrier includes a pair of sidewalls 29 between which a box-shaped lever 30 is pivotally mounted on suitable horizontal pivots 31 carried in the respective sidewalls 29. As best seen in FIG. 7, the lever 30 includes a first end portion 32 pivotally receiving the bight portion 33 of a U-shaped link 34, with opposite legs of which are provided with outturned end portions 35. The end portions 35 are slidably received in a pair of vertical slots 36 in the sidewalls 37 of the carrier. A second U-shaped link 38 is provided with a bight 39 pivotally received in the opposite end 40 of the lever 30, the opposite legs of the U-shaped link 38 having outturned ends 41 slidably extending through slots 42 in an upper portion of the carrier sidewalls 37.

Figure 3:
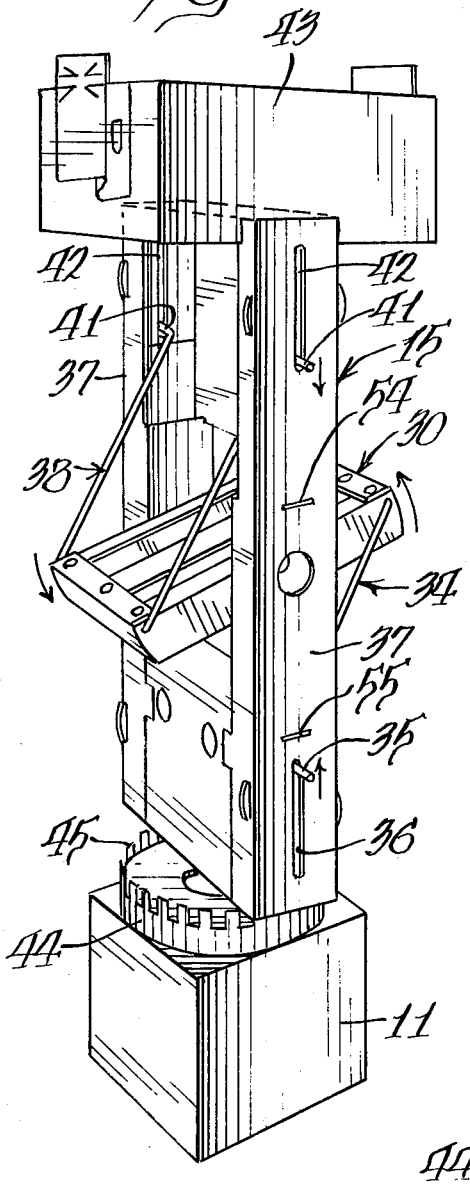
FIG. 3 is a perspective view of the support portion of the display device.
Figure 4:
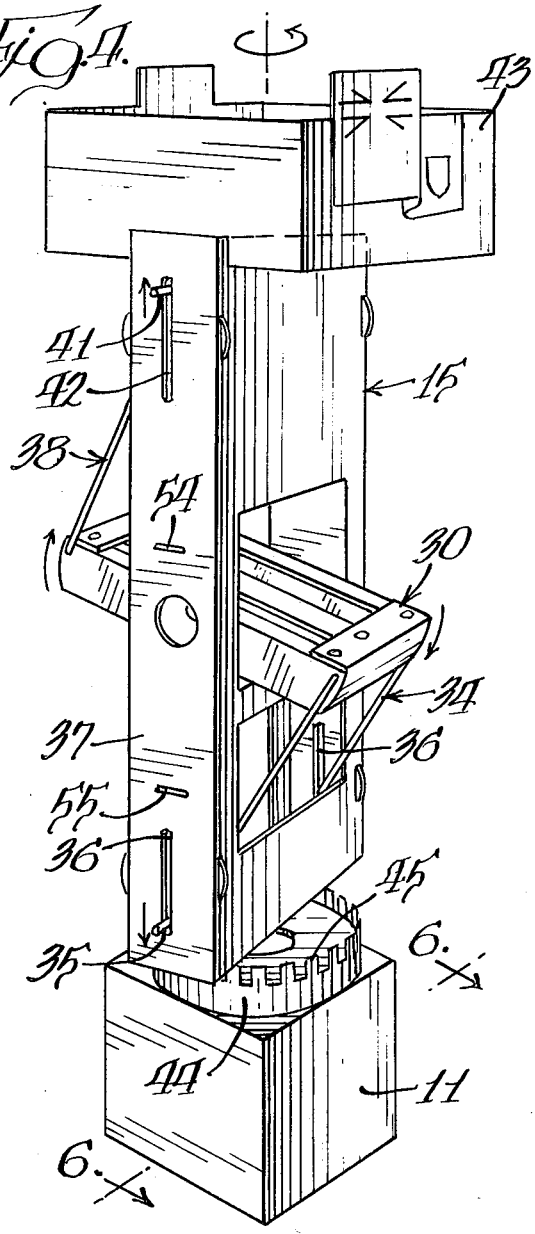
FIG. 4 is a perspective view illustrating the support portion of FIG. 3 in a disposition approximately 90° degrees from the disposition of FIG. 3.

A top member 43 may be mounted to the upper end of the carrier, as shown in FIGS. 3 and 4.

Figure 5:
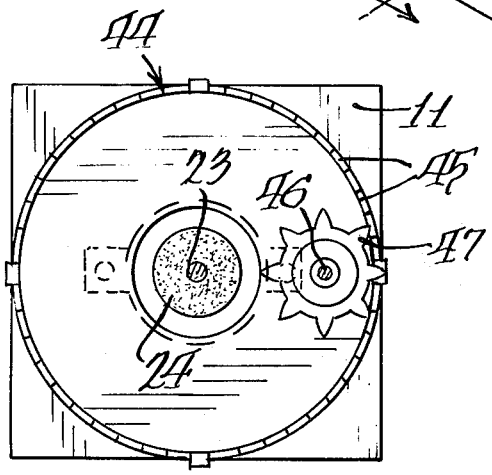
FIG. 5 is a horizontal section taken substantially along the line 5—5 of FIG. 6.

Surmounted to base 11 is a bull gear 44 defining a plurality of upstanding teeth 45. A drive shaft 46 is journaled at its lower end in the bottom wall 26 of the carrier. and at its upper end in the upper wall 28 of the carrier, as best seen in FIG. 7. The lower end of shaft 46 is provided with a gear 47 which, as best seen in FIG. 5, meshes with teeth of 45 of the bull gear 44.

The upper end of shaft 46 is journaled in a bearing 48. The upper distal end of the shaft includes a finger portion 49 extending from an angled connecting portion 50. The finger portion 49 extends through a rectilinear slot 51 in lever 30 extending radially to the axis 16 of the rotation shaft 20.

Figure 1:
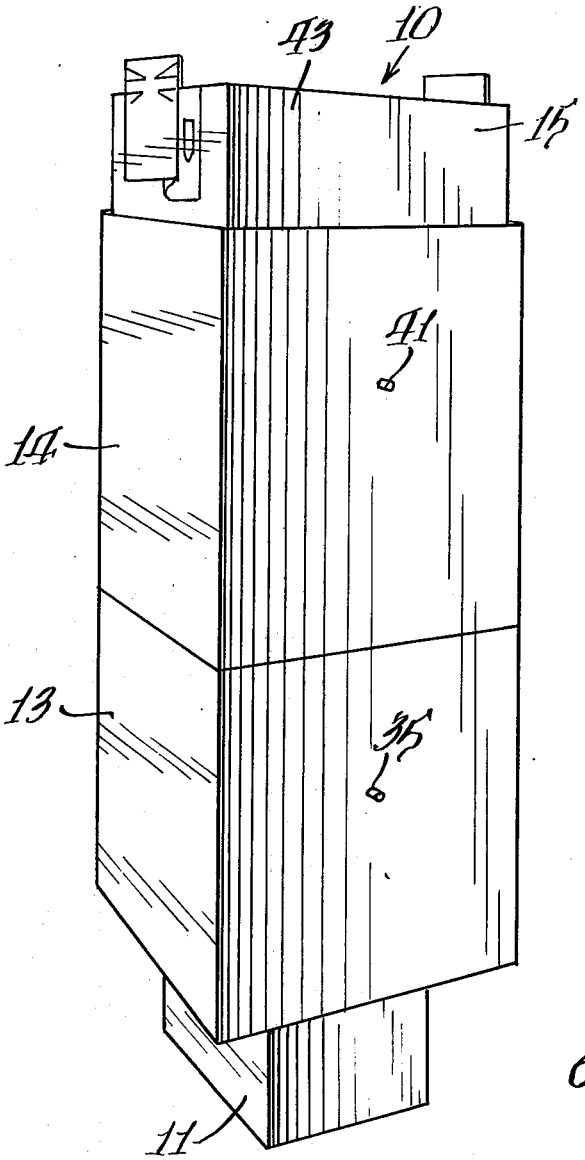
FIG. 1 is a perspective view of a display device embodying the invention, with the second and third displays thereof in juxtaposed dispositions.
Figure 2:
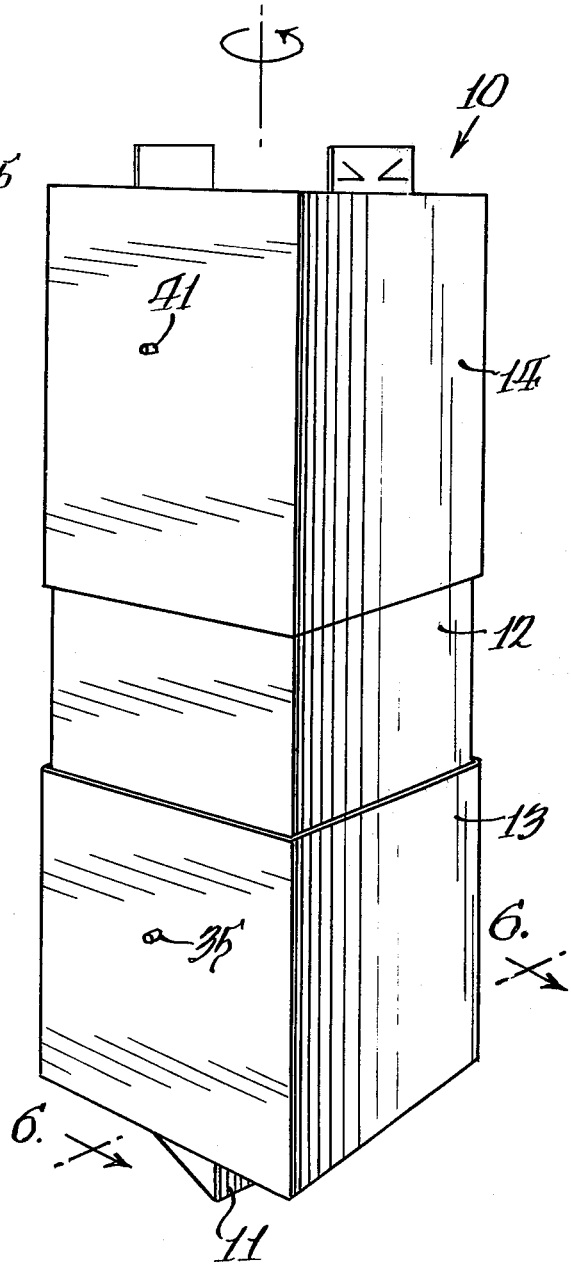
FIG. 2 is a perspective view illustrating the rotation of the display approximately 90° from the disposition of FIG. 1 and with the second and third displays of the device being in spaced relationship.

As best seen in FIGS. 1 and 2, the second display 13 is hung on the outturned ends 35 of the U-shaft link 34 and the upper display 14 is hung on the outturned ends 41 of the upper U-shaped links 38. First display 12, as shown in FIGS. 6 and 7, is mounted to the carrier sidewalls 37 by suitable tabs 52 and 53 received in upper slots 54, lower slots 55 of the carrier sidewalls.

Thus, in operation, energization of drive motor 17 effects a rotation of shaft 20 about the vertical axis 16 so as to rotate the carrier 15 supported on collar 24 also about the vertical axis. The first display 12 being fixedly mounted to the carrier, as indicated above, rotates directly with the carrier. The second and third displays, however, being mounted to the U-shaped links 34 and 38, respectively, while also rotating with the carrier about axis 16, also describe reciprocal vertical movement toward and from each other, as illustrated in FIGS. 1 and 2.

As shown in FIGS. 1 and 2, the displays may define parallelepiped displays so that each of the displays may present four different aspects. The second and third displays effectively cover and uncover the first display and the arrangement of the gear teeth 45 in such that such presentation seriatim of display 12 is effected a number of times while a given face of the display 12 is in a particular general orientation.

Thus, the pivoting of lever 30 about the horizontal axis of pivots 31 is effected by a motion-converting means which is responsive to rotation of the second gear means 47 by the bull gear 44 as the carrier is rotated about the vertical axis 16. The connecting means of U-shaped links 34 and 38 being connected between portions of the control lever spaced from the axis of pivots 31 connects the second and third displays so as to effect reciprocation thereof relative to each other during the concurrent rotation of the first, second and third displays about the vertical axis 16 to provide a unique display movement which has been found to be highly advantageous, such as for advertising purposes and the like. In the illustrated embodiment, the second and third displays comprise hollow structures movably surrounding the first display, although, as will be obvious to those skilled in the art, any suitable arrangement of the different displays may be provided within the scope of the invention.

The finger 49 cooperates with the slot 51 of the lever 30 so as to effectively define a slide member which is revolved about the axis of the shaft 46 and as a result of its reception in the rectilinear slot 46, effects a desired motion translation between the rotary motion of the shaft 46 and the desired reciprocal pivotal motion of the lever 30.

As will be obvious to those skilled in the art, the invention comprehends the provision of one or more vertically reciprocal displays arranged for rotation concurrently with the carrier and one or more fixed displays on the carrier, as desired.

Further as will be obvious to those skilled in the art, the reciprocation of the vertically movable displays may be effected in synchronization as well as in opposition, as in the disclosed embodiment, if so desired, by simply connecting the links to the same side of the pivot axis 31 rather than to opposite sides of the pivot axis, as shown in the illustrated embodiment.

Further, as will be obvious to those skilled in the art, the disposition of the pivot 31 may be other than at the center of the lever 30 so as to provide differential movements of the plural displays if so desired. Alternatively, the links 34 and 38 may be connected to the lever 30 at different distances from the pivot 31 so as to provide such differential movement if so desired.

As will be further obvious to those skilled in the art, the number of reciprocations of the vertically movable displays for each rotation of the device about the vertical axis 16 may be preselected as desired by suitably selecting the number of teeth of the bull gear 44 and driven gear 47.

Still further, as will be obvious to those skilled in the art, the invention comprehends the use of any suitable motion translating means for converting the rotary motion of the drive to a reciprocating motion of the display illustratively including cam means and other motion converting mechanisms as well as the disclosed gear-type translating means.

The foregoing disclosure of specific embodiments is illustrative of the broad inventive concepts comprehended by the invention.

I claim:

1. In a display device having a base, a first display, and rotary drive means carried by the base and drivingly connected to said first display to cause rotation thereof about a first axis, the improvement comprising:

first motion translating means carried by said base;

second motion translating means carried by said first display in operative association with said first motion translating means;

a control lever having a midportion pivotally mounted to said first display for reciprocable pivoting about a second axis transverse to said first axis;

first connecting means responsive to movement of said second motion translating means to reciprocably pivot said control lever about said second axis;

a second display adjacent said first display and second connecting means connected between a portion of said control lever spaced from said second axis and said second display for causing reciprocation of said second display relative to said first display while said first and second displays are being rotated concurrently about said first axis.

2. The display device of claim 1 wherein said second display defines a hollow structure movably surrounding said first display.

3. The display device of claim 1 wherein said first motion translating means comprises a first gear carried on the top of said base and said second motion translating means comprises a second gear in nested association with said first gear.

4. The display device of claim 1 wherein said first connecting means comprises a slide member revolved about an axis intersecting said second axis, and slot means carried by said control lever slidably receiving said slide member and extending parallel to said second axis.

5. The display device of claim 1 wherein said second connecting means comprises a link having a first end connected to said control lever portion and an opposite second end connected to said second display, and guide means carried by said first display for causing said second end to move said second display in a preselected manner adjacent said first display.

6. The display device of claim 1 wherein said first axis is vertical and said second connecting means is arranged to reciprocate said second display vertically.

7. The display device of claim 1 wherein said motion translating means are arranged to effect a plurality of reciprocations of said second display during each rotation of said displays.

8. In a display device having a base, a first display, and rotary drive means carried by the base for rotating said first display, the improvement comprising:

second and third displays; and connecting means for moving said second and third displays reciprocably relative to each other and rotatively with said first display as an incident of rotation of said first display by said drive means.

9. The display device of claim 8 wherein said connecting means alternatively juxtapose and space said second and third displays.

10. The display device of claim 8 wherein said second and third displays comprise hollow structures movably surrounding said first display.

11. The display device of claim 8 wherein said connecting means includes a control lever having a midportion pivotally mounted to said first display for pivoting about an axis, means responsive to rotation of said first display for reciprocally pivoting said lever about said axis, means connecting said second display to a first portion of said lever spaced from said axis and means connecting said third display to a second portion of said lever spaced oppositely from said axis whereby reciprocal pivoting of said lever causes reciprocal opposed movement of said second and third displays.

12. The display device of claim 8 wherein said first display includes rectilinear guide means for guiding said connecting means to cause rectilinear reciprocal movement of said second and third displays.

13. The display device of claim 8 wherein said axis is horizontal and said connecting means causes vertical reciprocation of said second and third displays.

14. The display device of claim 8 wherein said second and third displays are carried solely on said connecting means.

* * * * *